US006065622A

United States Patent [19]

Wurzer et al.

[11] Patent Number: 6,065,622

[45] Date of Patent: May 23, 2000

[54] SPOOL FOR LIGHTWEIGHT DRAWBAR ASSEMBLY

[75] Inventors: Jeffrey D. Wurzer, Turtle Creek; Shawn A. Opfer, Pittsburgh, both of Pa.

[73] Assignee: McConway & Torley Corporation, Pittsburgh, Pa.

[21] Appl. No.: 09/156,304

[22] Filed: Sep. 17, 1998

[51] Int. Cl.[7] ..... B61G 9/20

[52] U.S. Cl. ..... 213/62 R; 213/72

[58] Field of Search ..... 213/62 R, 62 A, 213/67 A, 67 R, 69, 72, 75 R, 50.5, 61

[56] References Cited

U.S. PATENT DOCUMENTS

| | | | |
|---|---|---|---|
| 4,456,133 | 6/1984 | Altherr et al. | 213/62 R |
| 4,580,686 | 4/1986 | Elliott | 213/62 A |
| 5,201,827 | 4/1993 | Glover et al. | 213/61 |
| 5,558,238 | 9/1996 | Daugherty et al. | 213/50.5 |
| 5,598,937 | 2/1997 | Clark | 213/62 R |

*Primary Examiner*—S. Joseph Morano
*Assistant Examiner*—Lars A. Olson
*Attorney, Agent, or Firm*—James Ray & Associates

[57] ABSTRACT

A spool for supporting an end of a drawbar in a drawbar coupler assembly, having a first pair of vertically disposed and parallel side wall members extending from a second pair of horizontally disposed and parallel top and bottom wall members, a first pair of axially aligned apertures centrally disposed in the first pair of horizontally disposed and parallel side wall members, each adapted to receive an interlocking disk-pin for pivotally connecting the spool to a support housing, a second pair of axially aligned apertures centrally disposed in the second pair of horizontally disposed top and bottom wall members, adapted to receive a drawbar pivot pin for pivotally connecting a drawbar within the spool.

20 Claims, 3 Drawing Sheets

SPOOL FOR LIGHTWEIGHT DRAWBAR ASSEMBLY

CROSS REFERENCE TO RELATED APPLICATIONS

The invention taught in this patent application is closely related to the inventions taught in four co-pending patent applications, namely: LIGHTWEIGHT DRAWBAR ASSEMBLY, Ser. No. 09/154,792, BEARING BLOCK FOR LIGHTWEIGHT DRAWBAR ASSEMBLY, Ser. No. 09/154,852, DRAWBAR FOR LIGHTWEIGHT DRAWBAR ASSEMBLY, Ser. No. 09/156,542, SUPPORT HOUSING FOR LIGHTWEIGHT DRAWBAR ASSEMBLY, Ser. No. 09/154,610, all of which are being filed concurrently herewith. These patent applications are assigned to the assignee of this invention, and the teachings therein are incorporated into this application by reference thereto.

FIELD OF THE INVENTION

The present invention relates, in general, to drawbar assemblies for interconnecting railway cars. More particularly, this invention relates to a unique spool construction for use within a drawbar assembly, which spool includes perpendicular pivot pins which function much like a universal joint to make the pivotal interconnection of the drawbar lighter in weight and stronger than more conventional drawbar assemblies, which is virtually slack free with greatly reduced frictional forces.

BACKGROUND OF THE INVENTION

In 1932, the Type E coupler was adopted as the ARA, American Railway Association (predecessor to the AAR, Association of American Railroads) standard coupler for railway freight cars. Although modified periodically since then to meet changing requirements imposed by changing demands, and other coupler designs have been developed for special applications, the Type E coupler is today still the standard coupler for freight service. As is well known, the Type E coupler as well as other standard use couplers, have a degree of free and cushioned slack. That is, a certain amount of free "play" exists between the coupler components when the load is changed from draft to buff loading, and visa versa. At the same time, the draft gear acts as a spring mechanism to cushion impact between adjacent cars. It has been found that eliminating the free and cushioned slack within a train can eliminate over the road train action forces due to "run-ins" and "run-outs". The magnitude of these forces are large and cause significant wear and tear of the rolling stock, and in some cases can be significant enough to cause derailments.

More recently, slackless drawbar couplers have come into use which were developed for use in unit train applications where interconnected cars are uncoupled only rarely for periodic inspection and repair, with the coupling essentially comprising a rigid drawbar with one end pivotally connected to one car and the other end pivotally connected to the adjacent car. Such jointed cars are not subjected daily to impact forces associated with bumping encountered in classification yards, and, therefore, do not require cushioning devices such as draft gears. Accordingly, because of their significant lighter weight, such slackless drawbar couplers are in widespread use in unit trains, such as coal trains, and other captive use applications.

An example of such a slackless drawbar coupling is disclosed in U.S. Pat. No. 4,580,686, the disclosure of which is incorporated herein by reference. This patented coupling system provides a drawbar arrangement for coupling railway cars each having a center sill and trucks at its opposite ends, the trucks being pivotal about vertical king pins. The drawbar has an enlarged spherical butt end portion defining essentially convex spherical buff and draft load surfaces, a rear support block having a tapered rear surface and a concave substantially hemispherical buff load bearing surface adapted to engage with the convex buff load bearing surface of the butt end portion of the drawbar, a slack adjusting wedge for engaging the tapered surface of the rear support block, means for transferring buff loads from the slack adjusting wedge to the center sill, a front draft block having a concave and substantially hemispherical draft load bearing surface adapted to engage with the convex draft load surface of the enlarged spherical butt end portion, the front draft block including an annular draft load surface opposite the hemispherical draft load surface thereof, a wear block having an annular draft load surface adapted to engage the annular draft load surface of the front draft block, and means supported by the center sill for transferring a draft load from the wear block to the center sill. Although there are other slackless drawbar designs, most can be divided into two basic types, those in which the drawbar is rotary, as described above where the drawbar has a spherical head portion, and those where the drawbar is not rotary, as for example, where the end of the drawbar is secured with a single pivot pin securing it to a base structure.

The above cited co-pending application titled "LIGHTWEIGHT DRAWBAR ASSEMBLY", Ser. No. 09/154,792, teaches a unique new and improved slackless drawbar system of the non-rotary type, which meets all AAR specifications, is significantly lighter in weight and yet stronger than prior art drawbar systems, and is virtually slack free.

SUMMARY OF THE INVENTION

This invention is predicated on a unique spool structure as may be utilized in that new and improved drawbar assembly, which spool provides perpendicular pivot pins which function much like a universal joint, and as a result minimizes structural mass, simplifying casting and machining requirements and virtually renders the coupling slack free.

In essence, the unique and improved slackless drawbar system itself, like other slackless drawbar systems, is adapted for use in combination with railway cars having a center sill, and is incorporated into the center sill. The assembly includes a drawbar having a shank portion extending to an enlarged truncated butt end portion defining essentially a convex, hemispherical buff load bearing surface, with an aperture at the axis of the hemispherical buff load bearing surface, with the shank portion projecting from the convex, hemispherical buff load bearing surface. A rear support block or follower is provided, having a concave, hemispherical buff load bearing surface disposed adjacent to the convex, hemispherical buff load bearing surface on the drawbar, and a gravity activated, slack adjusting wedge is utilized to maintain the intersecting hemispherical surfaces in biased contact.

The spool of this invention can be utilized for supporting the truncated butt end portion of the drawbar, and comprises a generally rectangular sleeve-like structure having a first pair of vertically disposed and parallel, side wall members transverse to a second pair of horizontally disposed and parallel, top and bottom wall members. The spool is further provided with a first pair of axially aligned apertures centrally disposed in the first pair of vertically disposed and parallel, side wall members, each adapted to receive an interlocking disk for pivotally connecting the spool to a support housing. The spool is also provided with a second pair of axially aligned apertures centrally disposed in the second pair of horizontally disposed, top and bottom wall members, which are adapted to cooperatively receive a drawbar pivot pin.

A support housing is securable to the center sill of the railway car to support the spool described above, and has a rectangular cavity in an outer, rearward end adapted to receive the spool, with the rectangular cavity having opposed and aligned apertures in opposed side walls thereof, each adapted to receive an interlocking disk such that the spool is pivotally attached within the cavity of the support housing for pivotal movement on the horizontally disposed interlocking disks for pivotal movement in a vertical plane. A drawbar pivot pin is secured within the second axially aligned apertures in the spool and extends through the aperture through the drawbar, such that the drawbar is pivotally attached to the drawbar pivot pin for pivotal movement in a horizontal plane. Accordingly, the drawbar is pivotal in one plane on the drawbar pivot pin, while the spool is pivotal in a perpendicular plane on the interlocking disks.

As in other slackless drawbar designs, a gravity activated, slack adjusting wedge is disposed between a rear support block and a side surface of the cavity in the support housing which is adapted to bias the rear support block against the convex partial hemispherical buff load bearing surface of the drawbar.

OBJECTS OF THE INVENTION

It is, therefore, one of the primary objects of the present invention to provide a new and improved apparatus for pivotally joining a railway drawbar within a center sill of a railway car.

Another object of the present invention is to provide a new and improved apparatus for pivotally joining a railway drawbar within a center sill of a railway car which is not only lighter in weight than comparable prior art devices, but is also stronger and virtually slack free.

A further object of this invention is to provide a unique lightweight spool structure for pivotally joining a railway drawbar to a center sill of a railway car which contains pivot pins disposed at right angles to thereby permit pivotal movement of the drawbar in any direction.

Still another object of the present invention is to provide a unique spool structure which functions much like a universal joint to pivotally interconnect a drawbar to a railway car center sill.

In addition to the above-identified objects and advantages of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 1:
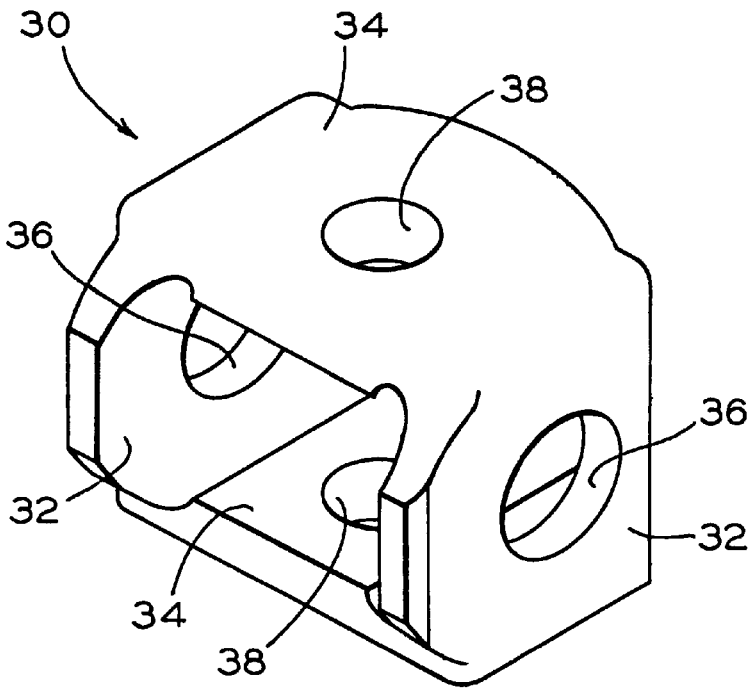
FIG. 1 is an isometric view of a spool in accordance with a preferred embodiment of this invention.
Figure 2:
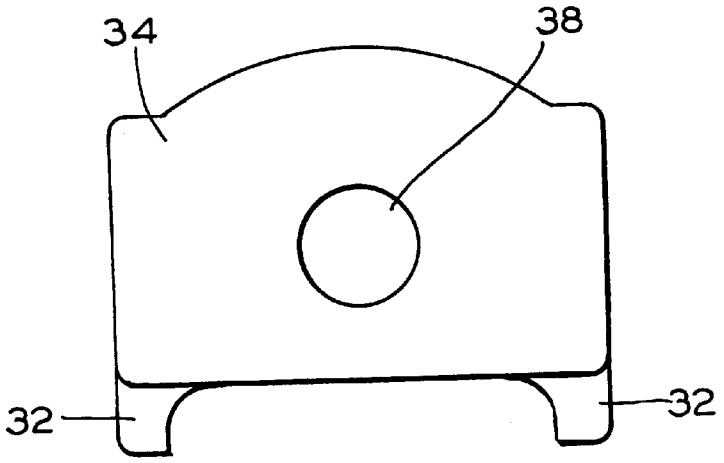
FIG. 2 is a top view of the spool shown in FIG. 1.

Prior to proceeding with a more detailed description of the invention, it should be noted that, for the sake of clarity and understanding, identical components having identical functions have been identified with identical reference numerals throughout the several views of the drawings.

Figure 5:
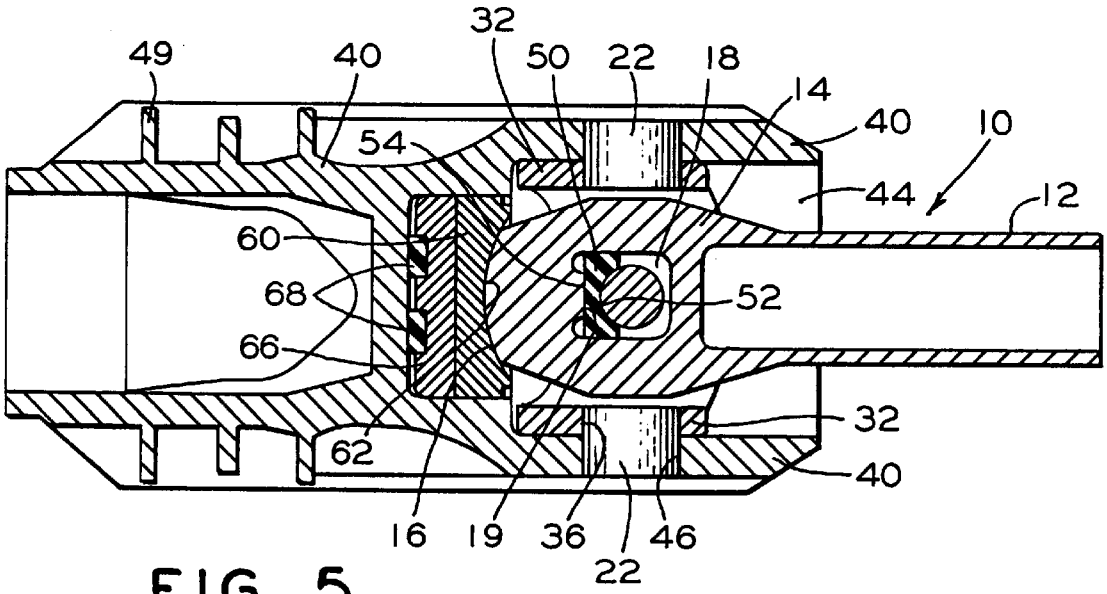
FIG. 5 is a plan view of the complete coupler assembly showing how the spool shown in FIGS. 1–4, is incorporated therewith.
Figure 6:
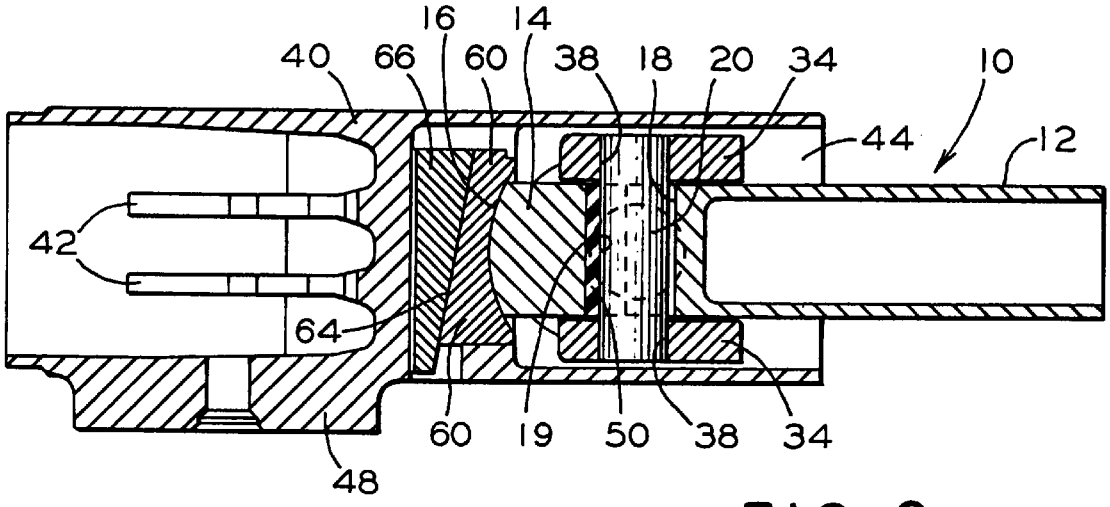
FIG. 6 is an elevational side view of the complete coupler assembly illustrated in FIG. 5.

Before considering the unique and inventive spool of this invention, a complete understanding of the unique drawbar assembly would be helpful. Accordingly, reference to FIGS. 5 and 6 will illustrate the unique slackless drawbar assembly to which the spool of this invention is related, wherein a presently preferred embodiment comprises an elongated drawbar 10 having a shank portion 12 extending to an enlarged truncated butt end portion 14, defining essentially a convex, partial hemispherical buff load bearing surface 16, and having a generally rectangular aperture 18 at the axis of said hemispherical buff load bearing surface 16. As can be seen, the shank portion 12 projects forwardly from the convex, partial hemispherical buff load bearing surface 16. While the drawbar 10 is shown to be rectangular in cross-section, other cross-sectional forms would work as well. Although the buff load bearing surface 16 is hemispherical, it is clear that it is not a full hemisphere, in that it is limited by the rectangular side edges of the drawbar 10. Accordingly, while a fuller hemispherical form could be utilized if desired, such would merely add unnecessary weight and mass to the drawbar 10.

This invention is addressed to a unique spool 30 which is provided for supporting an end of drawbar 10, wherein the spool 30 comprises a generally rectangular sleeve-like body having a first pair of parallel side wall members 32 vertically extending from a second pair of parallel, horizontally disposed top and bottom wall members 34. Hence, wall members 32 and 34 essentially define a box-like sleeve body with both horizontal ends open, into which an end of drawbar 10 is inserted. A first pair of axially aligned apertures 36 are disposed through the first pair of parallel, vertically disposed, side wall members 32 each of which is adapted to receive an interlocking disk member 22 for pivotally connecting spool 30 to a support housing 40 described below. A second pair of axially aligned apertures 38 are disposed in the second pair of parallel, horizontally disposed, top and bottom wall members 34, which are adapted to receive a drawbar pivot pin 20.

A support housing 40, adapted to support the entire drawbar assembly, is securable to the center sill (not shown) of a railway car (not shown) by any technique such as welding. The support housing 40 is provided with a rectangular cavity 44 in the outer, rearward end thereof, which cavity 44 is adapted to receive and pivotally retain spool 30. The dimensions of cavity 44 must be sufficient to contain spool 30 and to permit some pivotal movement of spool 30 in a vertical plane. Cavity 44 is provided with a pair of axially aligned apertures 46 in the vertical side walls which apertures 46 are aligned with the first pair of axially aligned apertures 36 disposed in the first pair of vertically disposed, parallel side wall members 32 of spool 30. As was noted above, each aperture 36 is adapted to receive an interlocking disk member 22 for pivotally connecting spool 30 to the support housing 40. Hence each interlocking disk member 22 is disposed through an aperture 46 in support housing 40 and the adjacent, mating aperture 36 in spool 30, such that spool 30 is pivotal in a vertical plane on the interlocking disk members 22. Accordingly, the two interlocking disk members 22, although spaced apart, are axially aligned to function as would a single pin. Although not material for the purposes of this invention, support housing 40 is further provided with cylindrical center plate 48 protruding downwardly from the underside to which a truck (not shown) can be rotatably attached, and a plurality of laterally extending vertical flanges 49, which are utilized to facilitate welding of the support housing 40 to the center sill 8.

The above described drawbar 10 is secured within spool 30 by inserting the butt end portion 14 through the rearward rectangular opening of spool 30 such that rectangular aperture 18 through drawbar 10 will be aligned with apertures 38 extending through the parallel, horizontally disposed top and bottom wall members 34 on spool 30. Accordingly, drawbar pivot pin 20, inserted within aligned apertures 38, will also extend through rectangular aperture 18 in drawbar 10.

A rear support block or follower 60, having a concave, hemispherical, buff load bearing surface 62 on one side, opposite a flat angled surface 64 on the other side, is vertically disposed within rectangular cavity 44 of support housing 40, such that concave, hemispherical buff load bearing surface 62 is engaged against convex, hemispherical buff load bearing surface 16 on drawbar 10. As in many comparable prior art drawbar assemblies, a gravity activated, slack adjusting wedge 66 is disposed between a rear end wall of rectangular cavity 44 and the adjacent vertical surface 64 of rear support block 60. Accordingly, gravitational forces tending to pull gravity wedge 66 downwardly within cavity 44, will serve to bias gravity wedge 66 against rear support block 60, and accordingly bias concave, hemispherical buff load bearing surface 62 against its convex counter part on drawbar 10, namely surface 16.

Preferably, a gravity wedge 66 is provided with a biasing surface of an elastomeric material, which as shown, preferably comprises a pair of elongated elastomeric strips 68 vulcanized within a pair of vertical recesses on the rearward facing surface of gravity wedge 66, such that the elastomeric strips will be in contact with the flat end wall of rectangular cavity 44.

While the above discussion is addressed primarily to the entire drawbar coupler assembly, this invention is limited to the spool 30 as utilized in the above-described assembly, and as noted, spool 30 is provided for supporting an end of drawbar 10, and comprises a generally rectangular sleeve-like body having a first pair of parallel side wall members 32 vertically extending from a second pair of parallel, horizontally disposed top and bottom wall members 34. Hence, wall members 32 and 34 essentially define a box-like sleeve body with both horizontal ends open, into which an end of drawbar 10 is inserted. A first pair of axially aligned apertures 36 are disposed through the first pair of parallel, vertically disposed, side wall members 32, each of which is adapted to receive an interlocking disk member 22 for pivotally connecting spool 30 to a support housing 40 described above. A second pair of axially aligned apertures 38 are disposed in the second pair of parallel, horizontally disposed, top and bottom wall members 34, which are adapted to receive a drawbar pivot pin 20.

In considering the above disclosed spool 30 in more detail as shown in FIGS. 1–4, it will be noted that the first pair of apertures 36 have a somewhat larger diameter than the second pair of apertures 38. While this is not critically essential, is was deemed preferable to make apertures 36 somewhat larger than apertures 38 because the pivotal strength of spool 30 on interlocking disk 22 will not benefit from the structural integrity of a single pin through apertures 36, but rather must rely on the two separated interlocking disk members 22.

In addition to the above, it should be noted that the outer edges of all the wall members 32 and 34 are significantly beveled at the outer corner edges, which serve to eliminate any restriction to maximum rotation of spool 30 within the confined parameters of cavity 44 in support housing 40. In a like manner, is should be noted that the intersections of the inside surfaces of horizontal wall members 34 are significantly recessed with respect to the vertical wall members 32. This is to assure that the pivotal movement of wall members 34 is not restricted by coming into contact with the rear support block 60 or gravity wedge 66, as well as assuring that stress risers are not created at the intersecting corners.

Figure 3:
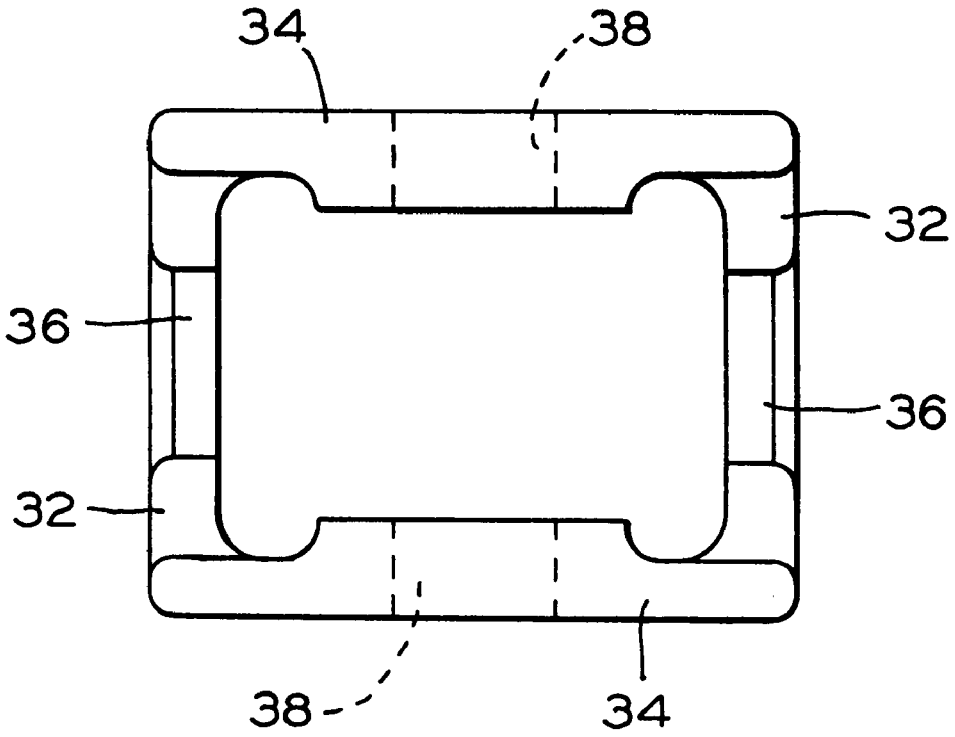
FIG. 3 is an end view of the spool shown in FIGS. 1 and 2.
Figure 4:
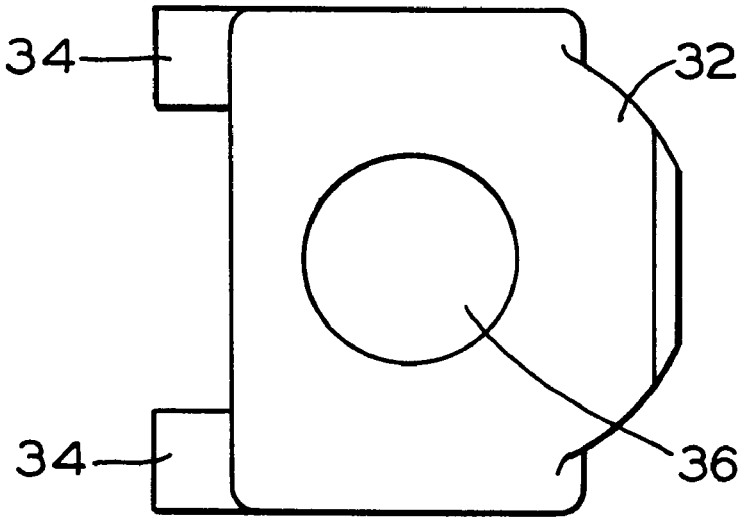
FIG. 4 is a side view of the spool shown in FIGS. 1–3.

With further regard to top and bottom horizontal wall members 34, it will be noted that the edges opposite the above discussed recessed edges are protruded outwardly by a circular edge to counter-balance the recessed portions, and provide a sufficient mass of wall portion to encircle the apertures 38. With reference to FIG. 3, which shows the configuration of the opening intermediate the four wall portions 32 and 34 of spool 30, it should be noted that the rectangular opening is not a perfect rectangle, but rather has half circular extensions extending to each side of vertical walls 32. While this is not essential to the invention, it is preferred to assure that the intersection edges do not interfere with the pivotal movement of the drawbar 10 therein, and also to avoid any stress risers that could be created at right angle intersecting surfaces.

While a presently preferred embodiment of the present invention has been described in detail above, it should be understood that persons skilled in the art may make various other modifications and adaptations of the invention without departing from the spirit or scope of the appended claims. For example, the above described specific configurations of the four wall members 32 and 34 can be altered to any extent desired, provided there is no surface or edge which would interfere with the essential pivotal movement of the spool 30 within cavity 44 on support housing 40, or the essential pivotal movement of the drawbar 10 interposed within the four wall members 32 and 34.

We claim:

1. A spool for supporting an end of a drawbar in a drawbar coupler assembly for interconnecting railway cars, said spool comprising a generally rectangular body having a first pair of parallel wall members extending from a second pair of parallel wall members, and with two open ends, a first pair of axially aligned apertures disposed in said first pair of parallel wall members each adapted to receive an interlocking disk-pin for pivotally connecting said spool structure to a support housing, a second pair of axially aligned apertures disposed in said second pair of wall members, adapted to receive a drawbar pivot pin.

2. A spool according to claim 1, in which said first and second pair of axially aligned apertures each have an axis which cross at an approximate center point of said spool.

3. A spool according to claim 1, in which the outer peripheral edges are beveled.

4. A spool according to claim 1, in which a lower horizontal wall member has an outer edge surface recessed inwardly.

5. A spool according to claim 4, in which said lower horizontal wall member having an outer edge recessed inwardly, has an opposed outer edge which protrudes outwardly.

6. A spool according to claim 5, in which said outwardly protruding portion of said lower horizontal wall member has a circular edge surface.

7. A spool according to claim 4, in which said first pair of axially aligned apertures have a larger diameter than said second pair of axially aligned apertures.

8. A spool according to claim 1, in which two horizontal wall members have an outer edge recessed inwardly.

9. A spool for supporting an end of a drawbar in a drawbar coupler assembly for interconnecting railway cars, said spool comprising a generally rectangular, four sided body having a first pair of vertically disposed and parallel side wall members extending from a second pair of horizontally disposed and parallel top and bottom wall members, and with two open ends, a first pair of axially aligned apertures centrally disposed in said first pair of horizontally disposed and parallel side wall members, each adapted to receive an interlocking disk-pin for pivotally connecting said spool to a support housing, a second pair of axially aligned apertures centrally disposed in said second pair of horizontally disposed top and bottom wall members, adapted to jointly receive a drawbar pivot pin for pivotally connecting a drawbar to said spool.

10. A spool according to claim 9, in which said first and second pair of axially aligned apertures each have an axis which cross at an approximate center point of said spool.

11. A spool according to claim 9, in which the outer peripheral edges of said wall members are beveled.

12. A spool according to claim 9, in which a lower horizontal wall member has an outer edge surface recessed inwardly.

13. A spool according to claim 12, in which said lower horizontal wall member having an outer edge recessed inwardly, has an opposed outer edge which protrudes outwardly.

14. A spool according to claim 13, in which said outwardly protruding portion of said lower horizontal wall member has a circular edge surface.

15. A spool according to claim 9, in which said first pair of axially aligned apertures have a larger diameter than said second pair of axially aligned apertures.

16. A spool according to claim 9, in which two horizontal wall members have an outer edge recessed inwardly.

17. A spool for supporting an end of a drawbar in a drawbar coupler assembly for interconnecting railway cars, said spool comprising a generally rectangular body having a first pair of vertically disposed and parallel side wall members extending from a second pair of horizontally disposed and parallel top and bottom wall members, defining a four sided sleeve having a top, bottom and two side wall members with two open ends, a first pair of axially aligned apertures centrally disposed in said first pair of vertically disposed and parallel side wall members each adapted to receive an interlocking disk-pin for pivotally connecting said spool to a support housing, and a second pair of apertures centrally disposed in said second pair of horizontally disposed top and bottom wall members adapted to receive a drawbar pivot pin for pivotally connecting a drawbar to said spool, said first and second pair of apertures each having an axis which cross at an approximate center point of said spool.

18. A spool according to claim 17, in which the outer peripheral edges are beveled.

19. A spool according to claim 17, in which a said top and bottom wall member have an outer edge surface recessed inwardly on one side, and are counter balanced by outward protuberances on the other side.

20. A spool according to claim 17, in which said first pair of axially aligned apertures have a larger diameter than said second pair of axially aligned apertures.

* * * * *